US007124754B2

(12) United States Patent
Sorheim

(10) Patent No.: US 7,124,754 B2
(45) Date of Patent: Oct. 24, 2006

(54) METHOD AND DEVICE FOR CREATING A DECORATIVE BLOCK FEATURE

(75) Inventor: Daniel R. Sorheim, Medford, MN (US)

(73) Assignee: Custom Precast & Masonry, Inc., Faribault, MN (US)

( * ) Notice: Subject to any disclaimer, the term of this patent is extended or adjusted under 35 U.S.C. 154(b) by 0 days.

(21) Appl. No.: 10/853,589

(22) Filed: Aug. 6, 2004

(65) Prior Publication Data

US 2006/0027226 A1 Feb. 9, 2006

(51) Int. Cl.
*B28D 1/32* (2006.01)

(52) U.S. Cl. ..... 125/23.01; 125/24

(58) Field of Classification Search ..... 125/23.01, 125/24, 22, 35, 40, 41, 16.04, 12
See application file for complete search history.

(56) References Cited

U.S. PATENT DOCUMENTS

| | | | |
|---|---|---|---|
| 250,635 | A | 12/1881 | McLean |
| 868,838 | A | 10/1907 | Brewington |
| 994,027 | A | 5/1911 | O'Beirne |
| 1,188,919 | A | 6/1916 | England |
| 1,226,214 | A | 5/1917 | Hopkins |
| 1,329,893 | A | 2/1920 | Flynn |
| 1,985,992 | A | 1/1935 | Hayman |
| 2,016,382 | A | 10/1935 | McBurney |
| 2,589,304 | A | 3/1952 | Spangler |
| 2,619,829 | A | 12/1952 | Tatum |
| 3,877,236 | A | 4/1975 | O'Neill et al. |
| 4,003,172 | A | 1/1977 | Pawl |
| 4,190,384 | A | 2/1980 | Neumann |
| 4,278,364 | A | 7/1981 | Frehner |
| 4,379,659 | A | 4/1983 | Steiner |
| 4,384,810 | A | 5/1983 | Neumann |
| 4,470,728 | A | 9/1984 | Broadbent |
| 4,490,075 | A | 12/1984 | Risi et al. |
| 4,597,236 | A | 7/1986 | Braxton |
| 4,661,023 | A | 4/1987 | Hilfiker |
| D295,788 | S | 5/1988 | Forsberg |
| D295,790 | S | 5/1988 | Forsberg |
| D296,007 | S | 5/1988 | Forsberg |
| D296,365 | S | 6/1988 | Forsberg |
| D297,464 | S | 8/1988 | Forsberg |
| D297,574 | S | 9/1988 | Forsberg |
| D297,767 | S | 9/1988 | Forsberg |
| D298,463 | S | 11/1988 | Forsberg |
| 4,782,640 | A | 11/1988 | Scheiwiller |
| D299,067 | S | 12/1988 | Forsberg |
| 4,802,320 | A | 2/1989 | Forsberg |
| D300,253 | S | 3/1989 | Forsberg |
| D300,254 | S | 3/1989 | Forsberg |
| D301,064 | S | 5/1989 | Forsberg |
| 4,825,619 | A | 5/1989 | Forsberg |
| 4,884,378 | A | 12/1989 | Scheiwiller |
| 4,896,999 | A | 1/1990 | Ruckstuhl |
| 4,909,010 | A | 3/1990 | Gravier |

(Continued)

*Primary Examiner*—Dung Van Nguyen
(74) *Attorney, Agent, or Firm*—Oppenheimer Wolff & Donnelly LLP

(57) ABSTRACT

A method for creating a split face on a block, such as a retaining wall block, that includes curved features. The method includes using at least one curved blade to impart a splitting force on an unfinished block. The curve of the blade is imparted through the block as the block splits. The result is an irregular, broken split face having a curved feature.

21 Claims, 3 Drawing Sheets

U.S. PATENT DOCUMENTS 4,914,876 A 4/1990 Forsberg
4,922,678 A 5/1990 Scheiwiller
4,982,544 A 1/1991 Smith
D317,048 S 5/1991 Forsberg
RE34,314 E 7/1993 Forsberg
5,282,700 A 2/1994 Rodrique
5,294,216 A 3/1994 Sievert
5,350,256 A 9/1994 Hammer
5,353,569 A 10/1994 Rodrique
5,360,296 A 11/1994 Angelette
5,370,480 A 12/1994 Quaney
5,406,769 A 4/1995 Vidal et al.
5,417,523 A 5/1995 Scales
5,419,092 A 5/1995 Jaecklin
5,480,267 A 1/1996 Hagenah
5,484,236 A 1/1996 Gravier
5,487,623 A 1/1996 Anderson et al.
5,490,363 A 2/1996 Woolford
5,505,034 A 4/1996 Dueck
5,507,599 A 4/1996 Anderson et al.
5,511,910 A 4/1996 Scales
5,522,682 A 6/1996 Egan
5,528,871 A 6/1996 Brodeur
5,551,809 A 9/1996 Forsberg
5,568,994 A 10/1996 Dawson
5,588,262 A 12/1996 Dawson
5,601,384 A 2/1997 Dawson
5,623,797 A 4/1997 Gravier et al.
D380,560 S 7/1997 Forsberg
D381,086 S 7/1997 Forsberg
5,653,558 A 8/1997 Price
D384,168 S 9/1997 Stevenson
D387,434 S 12/1997 Dawson
5,704,183 A 1/1998 Woolford
5,709,062 A 1/1998 Woolford
5,711,129 A 1/1998 Woolford
5,722,386 A * 3/1998 Fladgard et al. ..... 125/23.01
5,771,631 A 6/1998 Dawson
5,779,391 A 7/1998 Knight
D397,230 S 8/1998 Forsberg
D397,451 S 8/1998 Stevenson
5,795,105 A 8/1998 Guth
D397,808 S 9/1998 Dawson
5,827,015 A 10/1998 Woolford et al.
5,865,006 A 2/1999 Dawson
5,879,603 A 3/1999 Sievert
D411,315 S 6/1999 Bott
5,913,790 A 6/1999 Dawson
5,921,715 A 7/1999 Rainey
6,029,943 A 2/2000 Sievert
6,050,255 A 4/2000 Sievert
6,082,057 A 7/2000 Sievert
6,082,067 A 7/2000 Bott
D429,006 S 8/2000 Price et al.
D430,308 S 8/2000 Dawson
6,113,318 A 9/2000 Guth
6,113,379 A 9/2000 LaCroix et al.
6,138,983 A 10/2000 Sievert
6,142,713 A 11/2000 Woolford et al.
6,149,352 A 11/2000 MacDonald
D435,304 S 12/2000 Rainey
6,168,351 B1 1/2001 Rainey
6,168,353 B1 1/2001 Price
6,178,704 B1 1/2001 Sievert
D437,422 S 2/2001 Bolles et al.
6,183,168 B1 2/2001 Woolford et al.
D438,640 S 3/2001 Bolles et al.
6,209,848 B1 4/2001 Bolles et al.
6,224,815 B1 5/2001 LaCroix et al.
6,250,850 B1 6/2001 Price et al.
RE37,278 E 7/2001 Forsberg
D445,512 S 7/2001 Sievert
6,312,197 B1 11/2001 Woolford et al.
6,318,934 B1 11/2001 Borgersen et al.
6,321,740 B1 11/2001 Scherer et al.
6,322,291 B1 11/2001 Rainey
6,322,742 B1 11/2001 Bott
6,338,597 B1 1/2002 Rainey
D458,693 S 6/2002 Sievert
D459,487 S 6/2002 Bott
6,416,257 B1 7/2002 Rainey
6,447,213 B1 9/2002 MacDonald
D464,145 S 10/2002 Scherer et al.
6,464,199 B1 10/2002 Johnson
6,523,317 B1 2/2003 Bott et al.
6,536,994 B1 3/2003 Race
6,540,501 B1 4/2003 Bott
6,592,301 B1 7/2003 Price et al.
D479,002 S 8/2003 Nordstrand
D479,003 S 8/2003 Nordstrand
6,609,695 B1 8/2003 LaCroix et al.
D479,342 S 9/2003 Dawson
6,612,784 B1 9/2003 Rainey et al.
6,615,561 B1 9/2003 MacDonald et al.
6,616,382 B1 9/2003 Woolford et al.
6,637,981 B1 10/2003 MacDonald
D482,133 S 11/2003 Scherer et al.
6,641,334 B1 11/2003 Woolford
6,651,401 B1 11/2003 Price et al.
6,652,196 B1 11/2003 Rainey
6,682,269 B1 1/2004 Price et al.
6,709,201 B1 3/2004 Race
D488,242 S 4/2004 MacDonald
D488,568 S 4/2004 MacDonald
D488,569 S 4/2004 Dawson
D490,542 S 5/2004 MacDonald
6,758,636 B1 7/2004 Rainey et al.
6,827,073 B1 * 12/2004 Morrell ..... 125/23.01

* cited by examiner

METHOD AND DEVICE FOR CREATING A DECORATIVE BLOCK FEATURE

BACKGROUND OF THE INVENTION

The method and device of the present invention relate to the production of retaining wall blocks having decorative front features.

Over the past several years, the popularity of aggregate blocks for use in building retaining walls has increased dramatically. This increase in popularity has predictably been accompanied by an increase in the number of block types available for purchase by landscapers and homeowners alike.

Most of the blocks on the market are of similar composition and quality. For the average buyer, selecting one block over another usually becomes a matter of aesthetics. The most popular blocks include a broken front face. Broken front faces are created by molding a double block—a block that, when split, will become two finished blocks. The double blocks lack front faces. The front faces of the two finished blocks are created by splitting the double block down the center. Splitting the block involves placing the blocks between two opposing blades along a split line. The blades are moved slightly toward each other, causing the block to break in half. The result is a broken front face that is very irregular and unique. A wall made up of blocks having broken front faces is attractive because it is more complex and less patterned than walls created from blocks having molded front faces.

The popularity of the broken front face led to the creation of a block with three broken front faces. These blocks have a center front face that is relatively normal to the depth of the block, and two side front faces that angle rearwardly, and may be created by making two subsequent splits after the double block is split into two blocks. Time saving measures have included using blades having multiple straight portions to create angled cuts in a single step. These angled cuts have heretofore always involved angles that splay away from the centerline. Angling toward the centerline, in order to produce a somewhat scalloped, or concave effect in the front face of a wall block have not been successful due, in part, to the binding effect on the blade of the material being cut away. Curved cuts have also not been attempted.

The three faced design is easily the most popular block design being sold today, and has resulted in significant litigation among competitors. Inevitably, a design loses distinction as its popularity grows, which eventually results in waning sales. However, broken faces are objectively more attractive than smooth faces due to the rustic look and interesting shadows cast by the irregularities in the broken faces. Unfortunately, the present splitting techniques are limited in their ability to create different effects. Additionally, creativity with the present splitting techniques usually comes at the cost of significant wasted block material.

There is a need for an alternative splitting technique that allows unique curved patterns to be made in the front face of a retaining wall block.

There is also a need for an alternative splitting technique that can create unique patterns in the front face of a retaining wall block with a single split.

There is a further need for an alternative splitting technique and device that allows concave features to be formed in the front face of a retaining wall block.

BRIEF SUMMARY OF THE INVENTION

The present invention relates to a splitting blade and a method that allows a retaining wall block to be split along curved lines. By providing a curved splitting blade, or two opposing curved splitting blades, the curve of the splitting blade is surprisingly transferred through the block as it is split into two finished blocks.

One aspect of the present invention is a blade for use in splitting blocks comprising a body and at least one curved portion operably attached to the body, the at least one curved portion having a curved cutting edge. The blade may further comprise at least one straight portion operably attached to the body, the at least one straight portion having a straight cutting edge.

Another aspect of the present invention is a method of creating a split curved feature on a composite block comprising providing a splitting device having at least one blade with at least one curved portion, placing a block in operable proximity to the at least one curved portion of the at least one blade, and exerting a force on the block with the at least one curved portion of the blade sufficient to split the block. The splitting device may have two opposing blades, one or each of which having at least one curved portion. The block may then be placed between the two opposing blades and the blades moved toward each other until the block splits. An interesting "tumbled" effect may be obtained by using opposed blades, each having curved features that do not align with each other.

Another aspect of the invention provides a blade for use in splitting blocks comprising a means for creating a curved split feature in a face of the block. The means may comprise a blade having at least one curved portion.

DETAILED DESCRIPTION OF THE INVENTION

Figure 1:
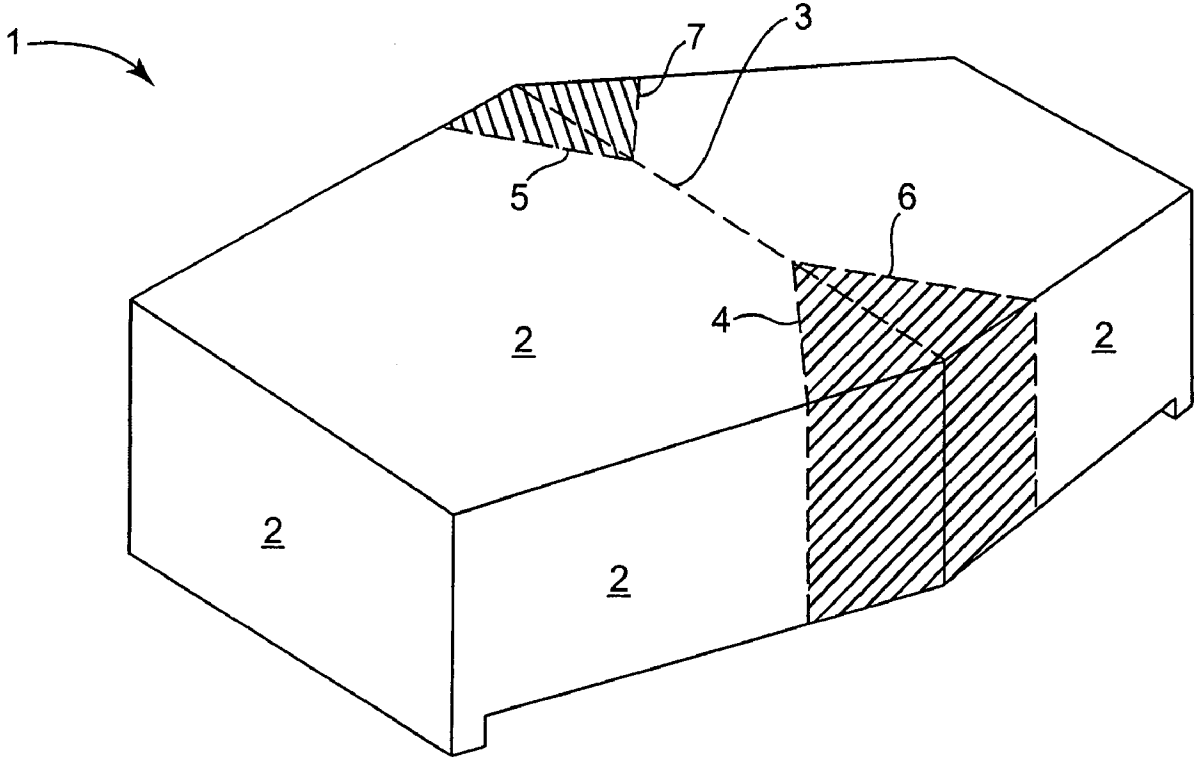
FIG. 1 is perspective view of an example of a double block that has not yet been split.

Referring now to the Figures, and first to FIG. 1, there is shown an example of a double-block 1 on which the method and device of the present invention may be used. The double-block 1 has been cast into the shape shown and needs only to be split into two blocks to be completed. Notably, the surfaces 2 are all smooth, as a result of the casting process. The block is ready to be split along a split line 3 (illuminated by a dashed line). Typically, a large, somewhat blunt blade is used, often in conjunction with a similar opposing blade, to break the double-block 1 into two finished blocks. The double block 1 is compressed between the two blades along the split line 3 and breaks into two finished blocks each having a relatively straight yet irregular, broken front face.

If it is desired to create a block having more facets, further breaks are made. A three-faced front surface is made by breaking the split blocks along lines 4, 5, 6 and 7. The shaded areas 8 are wasted material.

Figure 2A:
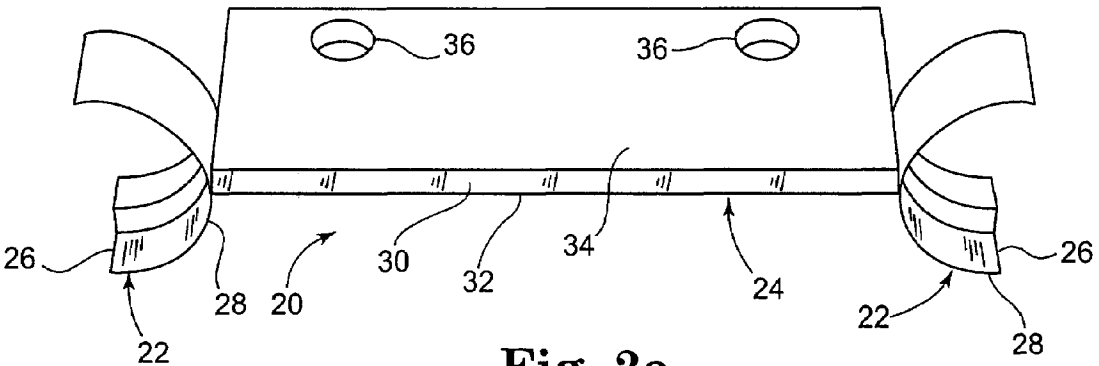
FIG. 2*a* is perspective view of an embodiment of a curved cutting blade of the present invention.

The present invention provides a method of creating curved, yet broken front faces using curved blades. FIG. 2*a* shows a blade 20 having curved portions 22 on either side of a straight portion 24. The curved portions 22 each have a curved tapered portions 26 that lead to a curved cutting edge 28. The cutting edge is dull when compared to conventional cutting blades of other types, such as knives, saw blades, and the like. Because the blade is just starting a crack in the block, rather than cutting through the entire block, and because it is used to cut aggregate rock materials, a dull cutting edge is stronger and lasts much longer than would a sharpened cutting edge.

Similarly, the straight portion 24 has a tapered portion 30 that leads to a straight cutting edge 32. The straight portion also has a body 34 that includes two attachment holes 36, useable to fasten the blade to a splitting device (not shown). The curved portions 22 may be attached to the blade at any desired location to create a desired effect. Further, the curved portions 22 may be attached by any acceptable means that will allow the curved portions to withstand the pressures of a splitting operation. Examples of acceptable attachment means include but are not limited to: welding, bolting, and forming the curved portions integrally with the rest of the blade, such as by casting, forging, or bending.

The method of the present invention includes splitting a block using a curved blade to create a split face with a curved portion. The first step is to place a block between a blade having a curved portion and an opposing surface. The opposing surface may be a similarly shaped blade, a straight blade, or even an edge. Alternatively the blade may not be aligned with an opposing surface, rather a space or giving surface may oppose the blade with the double-block being supported by firm surfaces outwardly displaced from a position directly opposing the blade. Another alternative would be to support the entire block on a slightly forgiving surface, such as rubber. Yet another alternative is to provide two opposed blades, each having curved portions that do not align with each other in order to create a "tumbled" effect on the front face of the block. The blade or blades are then forced toward the block until the block splits, thereby creating a split face with a curved portion.

Figure 2B:
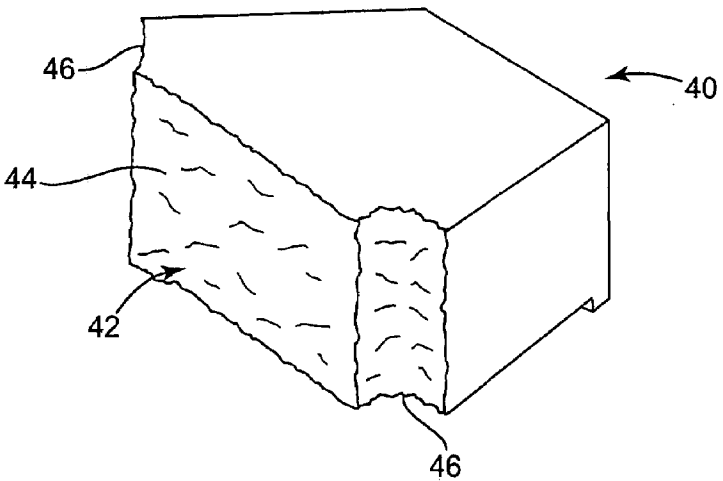
FIG. 2*b* is a perspective view of a retaining wall block split with the blade of FIG. 2*a;*

FIG. 2*b* is a finished block 40 that has been split using the blade 20 of FIG. 2*a*. The block 40 has a split face 42 that includes a flat portion 44 and two curved portions 46. The split face 42, with its curved portions 46, is somewhat complimentary to the shape of the blade 20. Due to the inherent variances between blocks, no two blocks 40 split using the blade 20 will have identical faces 42. If a double-block is used, such as that shown in FIG. 1, two such blocks 40 will result. One skilled in the art will realize that the rearward portion 48 of the block 40 is provided by way of example and that the method and device of the present invention can be used with any block design that incorporates a split face.

Figures 3A, 3B, 3C, 4:
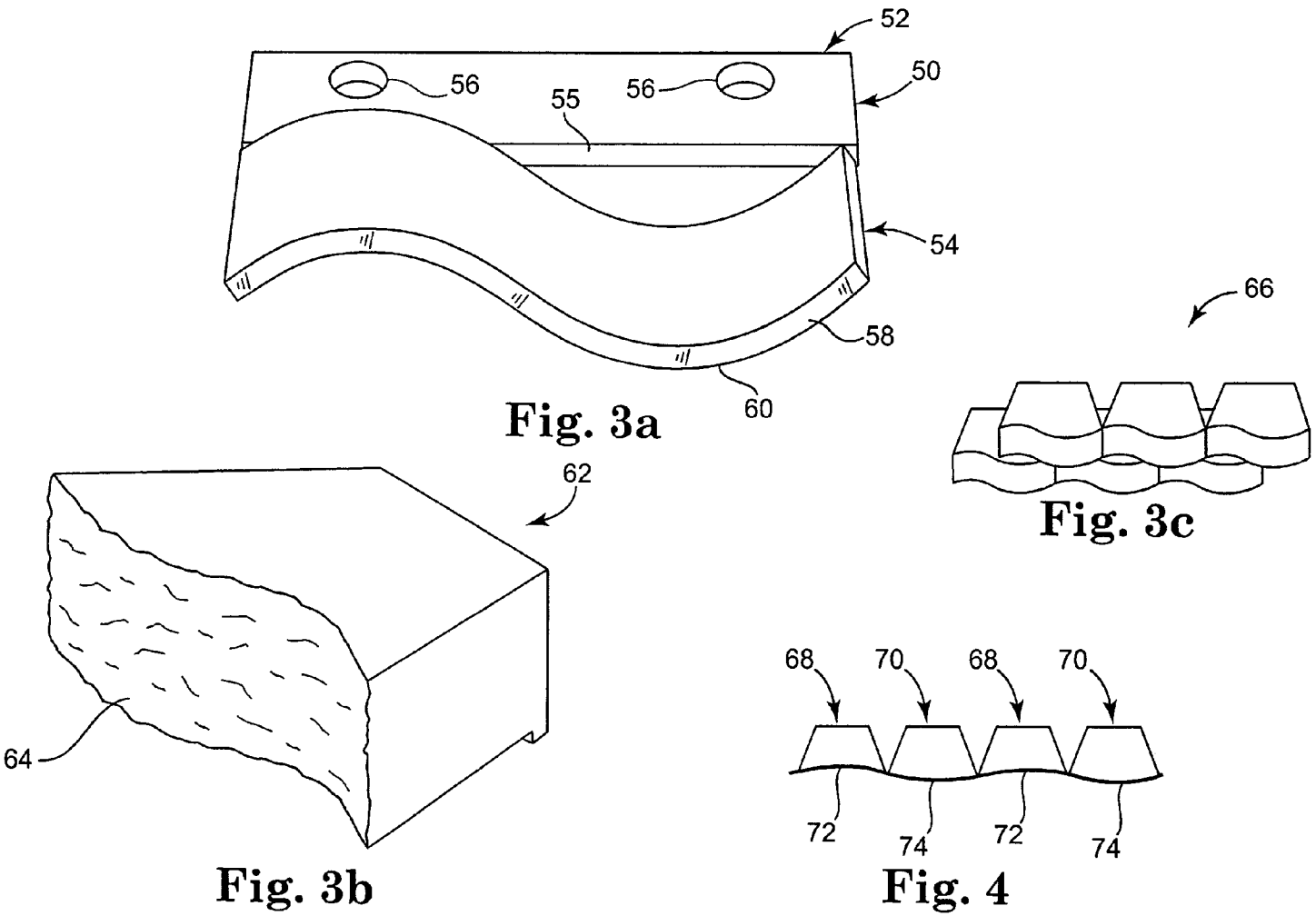
FIG. 3*a* is a perspective view of a second embodiment of a curved cutting blade of the present invention.
FIG. 3*b* is a perspective view of a retaining wall block split with the blade of FIG. 3*a;*
FIG. 3*c* is a perspective view of a portion of a wall constructed with blocks similar to the block of FIG. 3*b;* and, FIG. 4 is a plan view of a course of retaining wall blocks having been split using the method of the present invention.

Similarly, the present invention should be read as applying to all forms of curved blades. FIG. 3*a* provides another example of a curved blade design useable to accomplish the present invention. The blade 50 includes a body 52 and a curved cutting portion 54 attached to a distal edge 55 of the body 52. The body 52 has attachment points 56, shown as holes, for attaching the body 52 to a splitting device (not shown).

The curved cutting portion 54 has a tapered portion 58 and a dull cutting edge 60. The curved cutting portion 53 has been formed into a sine wave, and the blade 50 has no straight portion. The result is a block 62 (FIG. 3*b*) having a completely curved front broken face 64. A significant advantage to a block design, such as that shown in FIG. 3, is that two complementary, or substantially similar, blocks can be produced by splitting a double-block with no wasted material. Additionally, when the blocks 62 are arranged in a wall, the design complements the design of adjacent blocks, forming a wave like appearance such as that shown in the portion of a wall 66 in FIG. 3*c*.

A similar result could be achieved by providing a blade with a curved portion that is a semicircle or a one half of a sine wave. Referring to FIG. 4, it can be seen that splitting a double-block with such a blade would result in two different blocks 68 and 70 having complementary shapes. Each split would result in one block 68 having a concave split face 72 and another block 70 having a convex split face 74. When arranged in a wall, the faces 72 and 74 combine to form a sine wave having a wavelength equal to the widths of two blocks. Again, no material is wasted with this design.

The invention has herein been described in its preferred embodiments to provide those skilled in the art with the information needed to apply the novel principles and to construct and use the embodiments of the examples as required. However, it is to be understood that the invention can be carried out by specifically different devices and that various modifications can be accomplished without departing from the scope of the invention itself, which is set out in the following claims:

What is claimed is:

1. A blade for use in splitting a preformed double block into at least two blocks comprising:

a body;

at least one straight portion operably attached to the body, wherein the at least one straight portion has a straight cutting edge;

a first curved portion operably attached to the body, having at least one curved portion including a first curved cutting edge; and a second curved portion operably attached to the body having at least one curved portion including a second curved cutting edge substantially identical to the first curved cutting edge wherein the first curved portion and the second curved portion are operably attached to a first end and a second end of the straight portion, respectively, and wherein the first curved cutting edge and the second curved cutting edge are configured to contact the double block during splitting thus creating substantially similar structures in the resulting at least two blocks following the splitting of the double block.

2. The blade of claim 1 wherein the curved portions are concaved so as to produce a concave surface on each of the at least two blocks when splitting the blocks.

3. The blade of claim 1 wherein the first curved portion and the second curved portion are welded to the body.

4. The blade of claim 1 wherein the first curved portion and the second curved portion are bolted to the body.

5. The blade of claim 1 wherein the first curved portion and the second curved portion are formed integrally with the body.

6. The blade of claim 5 wherein the first curved portion and the second curved portion are cast with the body.

7. The blade of claim 5 wherein the first curved portion and the second curved portion are forged into the body.

8. The blade of claim 5 wherein the first curved portion and the second curved portion are bent into the body.

9. The blade of claim 1 wherein the first and second curved portions are are symmetrical with respect to an axis along the straight cutting edge.

10. A method of creating a curved feature on at least two composite blocks by splitting a double block, the method comprising:

providing a splitting device having a blade, wherein the blade has a body; at least one straight portion operably attached to the body, wherein the at least one straight portion has a straight cutting edge; and at least two curved portions operably attached to the body, wherein the at least two curved portions have curved cutting edges; and wherein the at least two curved portions are attached to ends of the straight portion;

placing a double block in operable proximity to the blade; and, exerting a force on the block with the blade sufficient to split the double block into two substantially similar blocks.

11. The method of claim 10 wherein the split curved feature is a concave feature on two sides of the block face and is created by having the at least two curved portions be concave.

12. The method of claim 10 wherein the step of placing a block in operable proximity to the blade comprises placing the block such that a split line on the block is aligned directly beneath the straight cutting edge and is transverse to the length of the double block.

13. The method of claim 10 wherein providing a splitting device having two opposing blades, wherein each blade has at least two curved portions attached to ends of a straight portion extending therebetween, and wherein the at least two curved portions of each blade are laterally offset from each other such that the at least two curved portions of each blade are not in alignment.

14. The method of claim 13 wherein the step of exerting a force on the block with the blade sufficient to split the block comprises moving one blade toward the opposing blade until the block splits.

15. A blade for use in splitting a double block into two substantially identical blocks comprising a means for creating a curved split feature in a face of each block, wherein the means for creating a curved split feature comprises a blade having at least two curved portions and a straight portion, wherein the at least two curved portions are positioned at opposing ends of the straight portion.

16. The blade of claim 15 wherein the at least two curved portions are convex with respect to the straight portion and are symmetrical with respect to an axis extending along the straight portion.

17. The blade of claim 16 wherein the at least two curved portions are each arced segments extending outwardly from the sides of the straight portion.

18. The blade of claim 17 wherein the at least two curved portions are half circles extending outwardly from the sides of the straight portion.

19. The blade of claim 15 wherein the at least two curved portions include curved tapered portions.

20. The blade of claim 19 wherein the at least two curved portions further include curved cutting edges.

21. The blade of claim 15 wherein the blade further comprises a body means for operably attaching the blade to a splitting device.

* * * * *